US007637318B2

(12) United States Patent
Sierra et al.

(10) Patent No.: US 7,637,318 B2
(45) Date of Patent: Dec. 29, 2009

(54) PRESSURE COMMUNICATION ASSEMBLY EXTERNAL TO CASING WITH CONNECTIVITY TO PRESSURE SOURCE

(75) Inventors: Jose Sierra, Katy, TX (US); David O. Johnson, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 195 days.

(21) Appl. No.: 11/394,139

(22) Filed: Mar. 30, 2006

(65) Prior Publication Data

US 2007/0235186 A1 Oct. 11, 2007

(51) Int. Cl.
*E21B 47/06* (2006.01)
*E21B 43/263* (2006.01)

(52) U.S. Cl. ..... 166/250.07; 166/299; 166/63; 166/308.1; 73/152.51

(58) Field of Classification Search ..... 166/250.02, 166/250.07, 250.11, 299, 298, 308.1, 55, 166/100; 702/11, 12; 73/152.05, 152.02, 73/152.18, 152.23, 152.24, 152.51; 102/313; 175/2, 4.53
See application file for complete search history.

(56) References Cited

U.S. PATENT DOCUMENTS 2,265,982 A * 12/1941 Bolton ..... 175/4.56
2,564,198 A * 8/1951 Elkins ..... 73/152.18
3,066,734 A * 12/1962 Meiklejohn ..... 166/283
3,971,317 A * 7/1976 Gemmell et al. ..... 102/313
4,010,642 A * 3/1977 McArthur ..... 73/152.51
4,252,015 A * 2/1981 Harbon et al. ..... 73/152.51
4,976,142 A 12/1990 Perales
5,163,321 A 11/1992 Perales
5,467,823 A * 11/1995 Babour et al. ..... 166/250.01
5,597,042 A 1/1997 Tubel et al.
6,296,058 B1 10/2001 Brieger
6,397,950 B1 6/2002 Streich et al.
7,325,597 B2 * 2/2008 Ringgenberg et al. ..... 166/66
2003/0164037 A1 * 9/2003 Moffatt et al. ..... 73/152.46
2004/0031319 A1 2/2004 Perales

OTHER PUBLICATIONS

SPE 25892, "Field Implementation of Proppant Slugs to Avoid Premature Screen-Out . . . " dated Apr. 12, 1993.
SPE 15370, "Technique for Considering Fluid Compressibility and Temperature Changes in Mini-Frac Analysis" dated Oct. 5, 1986.
SPE 16916, "Study of the Effects of Fluid Rheology on Minifrac Analysis" dated Sep. 27, 1987.
Untitled drawing, undated, describinga pressure and temperature measuring system which was prior to the conception of the claimed invention.
International Search Report and Written Opinion issued Nov. 4, 2008, for International Application No. PCT/ US07/65394, 7 pages.

* cited by examiner

*Primary Examiner*—Kenneth Thompson
(74) *Attorney, Agent, or Firm*—Marlin R. Smith

(57) ABSTRACT

A pressure communication assembly external to casing with various forms of connectivity to a pressure source. A well system includes a casing string positioned in the well, with a bore extending longitudinally through the casing string; a chamber attached to the casing string and positioned external to the casing string bore; and a device which provides fluid communication between an interior of the chamber and a pressure source external to the casing. A method of monitoring pressure in a well includes the steps of: installing a casing string in the well with a chamber positioned external to a through bore of the casing string, and the chamber being isolated from the well external to the casing string; and then actuating a device to thereby provide fluid communication between the chamber and the well external to the casing string.

20 Claims, 8 Drawing Sheets

PRESSURE COMMUNICATION ASSEMBLY EXTERNAL TO CASING WITH CONNECTIVITY TO PRESSURE SOURCE

BACKGROUND

The present invention relates generally to equipment utilized and operations performed in conjunction with a subterranean well and, in an embodiment described herein, more particularly provides a pressure communication assembly external to casing with various forms of connectivity to a pressure source.

It is known to use a chamber positioned in a wellbore and connected to a tube or control line extending to the surface for monitoring pressure in the wellbore. Pressure applied to the tube at the surface provides an indication of pressure in the wellbore at the chamber. Such systems are described in U.S. Pat. Nos. 4,976,142 and 5,163,321, and in U.S. Patent Application Publication No. 20040031319. The entire disclosures of these documents are incorporated herein by this reference.

However, these prior systems involve installing completion or production equipment in the wellbore and (if casing or liner and cement is installed) perforating the casing or liner and cement, or otherwise forming a fluid path between the wellbore and a formation or zone of interest. These operations are relatively expensive and time-consuming. In addition, the equipment installed in the wellbore at least partially obstructs the wellbore.

Therefore, it may be seen that improvements are needed in the art of monitoring pressure in wells. It is among the objects of the present invention to provide such improvements.

SUMMARY

In carrying out the principles of the present invention, well systems and associated methods are provided which solve at least one problem in the art. One example is described below in which a pressure communication assembly includes a chamber positioned external to a casing string. Another example is described below in which a passage is formed for fluid communication between the chamber and a pressure source after the casing string is cemented in the well.

In one aspect of the invention, a well system is provided which includes a casing string positioned in the well. A bore extends longitudinally through the casing string. A chamber is attached to the casing string and positioned external to the casing string bore. A device provides fluid communication between an interior of the chamber and a pressure source external to the casing.

In another aspect of the invention, a method of monitoring pressure in a well includes the steps of: installing a casing string in the well with a chamber positioned external to a through bore of the casing string, and the chamber being isolated from the well external to the casing string; and then actuating a device to thereby provide fluid communication between the chamber and the well external to the casing string.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
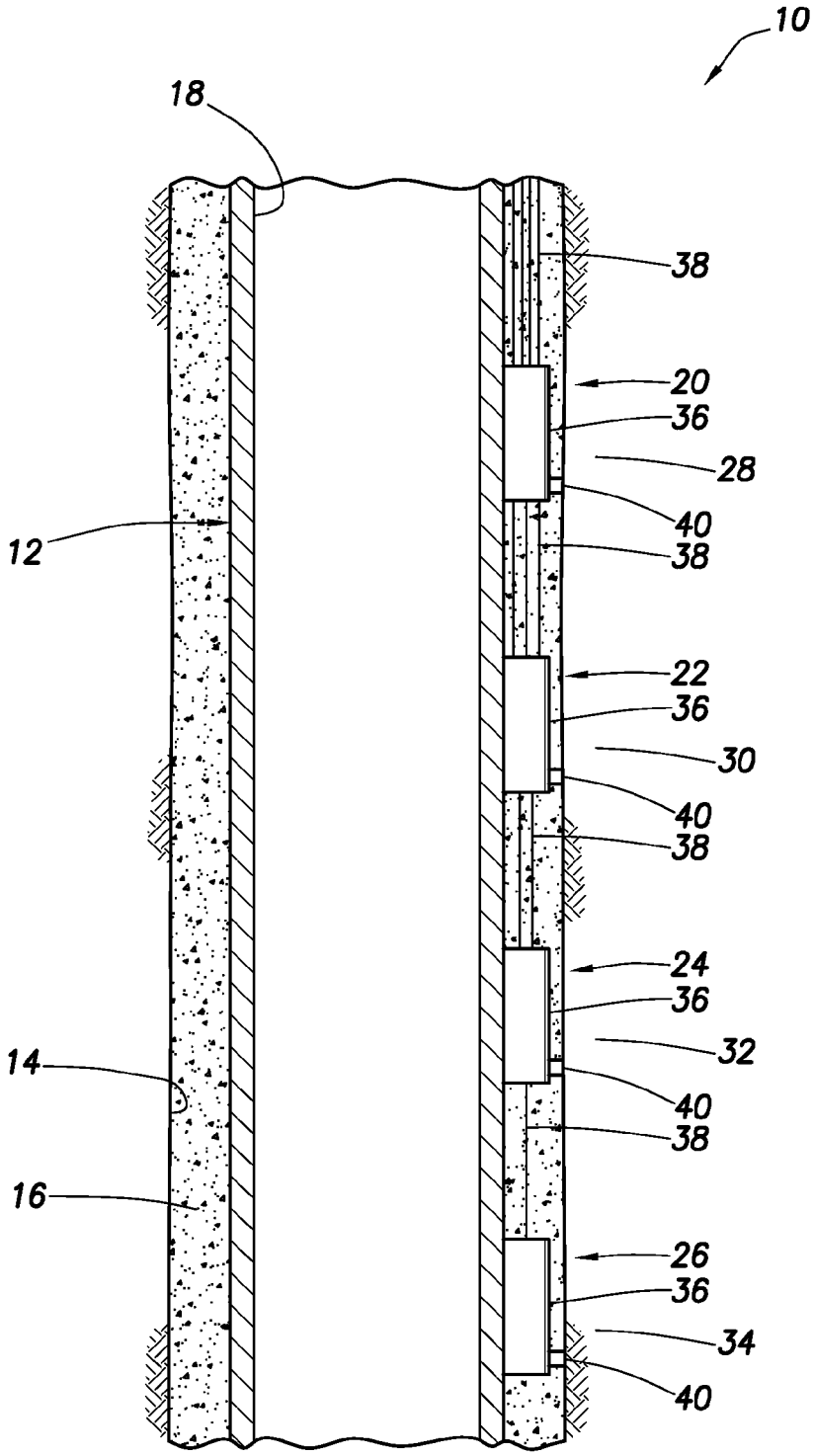
FIG. 1 is a partially cross-sectional schematic view of a well system embodying principles of the present invention.

Representatively illustrated in FIG. 1 is a well system 10 which embodies principles of the present invention. A casing string 12 has been installed in a wellbore 14 of the well, and cement 16 has been flowed into an annular space between the casing string and the wellbore. A bore 18 extends longitudinally through the casing string 12.

Note that the well system 10 is only one example of a wide variety of possible uses of the invention, and is described herein so that a person skilled in the art will appreciate how the invention is made and used. Accordingly, the casing string 12, cement 16 and other elements of the well system 10 should be understood to represent a variety of similar elements used in well operations.

For example, "casing," "casing string" and similar terms should be understood to include equipment known as "liner" and other forms of protective linings installed in wellbores, whether made of metal, composite materials, expandable materials or other materials, and whether segmented or continuous. As another example, "cement, "cementing" and similar terms should be understood to include any hardenable material used to secure and seal a wellbore lining in a well, such as epoxy or other polymer materials, non-cementitious materials, etc.

The well system 10 also includes multiple pressure communication assemblies 20, 22, 24, 26 spaced apart along the casing string 12. As depicted in FIG. 1, the pressure communication assemblies 20, 22, 24, 26 are used to monitor pressure in respective spaced apart zones or earth formations 28, 30, 32, 34. Note that the formations 28, 30, 32, 34 may be individual formations, or merely separate zones within a common formation, and one or more of the formations may be part of a common fluid reservoir.

Each of the assemblies 20, 22, 24, 26 includes a chamber 36 and a control line or capillary tube 38 connected to the chamber and extending to a remote location, such as the earth's surface. At the remote location, the tubes 38 are connected to a pressure gauge including, for example, a transducer and instrumentation (not shown) for monitoring pressure applied to the tubes at the remote location. For establishing fluid communication with the formations 28, 30, 32, 34, each of the assemblies 20, 22, 24, 26 also includes a connectivity device 40.

At this point several beneficial features of the well system 10 can be appreciated. The assemblies 20, 22, 24, 26 do not obstruct the bore 18 of the casing string 12. Completion or production equipment does not have to be installed in the casing string 12 prior to utilizing the assemblies 20, 22, 24, 26. The casing string 12 does not have to be perforated in order to monitor pressure in the formations 28, 30, 32, 34.

Furthermore, although the assemblies 20, 22, 24, 26 are cemented in place along with the casing string 12, the devices 40 are provided to form passages between the chambers 36 and the formations 28, 30, 32, 34. Thus, the devices 40 isolate the chambers 36 from the cement 16 during the cementing operation, and subsequently provide fluid communication between the chambers and the formations 28, 30, 32, 34.

The use of the multiple assemblies 20, 22, 24, 26 allows the integrity of the cement 16 to be tested after the cementing operation (e.g., to determine whether fluid isolation is achieved by the cement in the annular space between the casing string 12 and the wellbore 14). In addition, the multiple assemblies 20, 22, 24, 26 permit vertical interference tests to be conducted between the formations 28, 30, 32, 34.

Note that it is not necessary in keeping with the principles of the invention for multiple pressure communication assemblies to be installed, since a single pressure communication assembly could still be used to monitor pressure in a pressure source downhole. Also, it should be understood that an earth formation or zone is only one type of pressure source which may be monitored using the principles of the invention. For example, another pressure source could be the interior bore 18 of the casing string 12.

Figure 2:
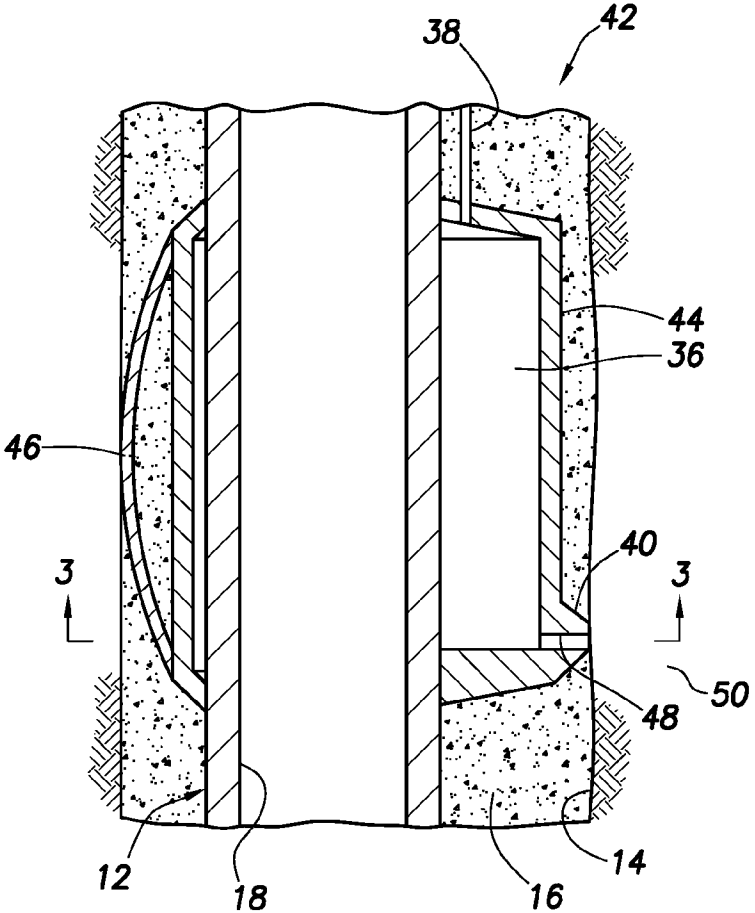
FIG. 2 is an enlarged scale cross-sectional schematic view of a pressure communication assembly which may be used in the well system of FIG. 1.

Referring additionally now to FIG. 2, a schematic cross-sectional view of a pressure communication assembly 42 which may be used for any of the assemblies 20, 22, 24, 26 in the well system 10 is representatively illustrated. The assembly 42 could be used in other well systems also, without departing from the principles of the invention.

In this embodiment, the assembly 42 includes a chamber housing 44 which is eccentrically arranged about the casing string 12. The housing 44 is welded, or otherwise sealed and secured, to the exterior of the casing string 12, so that the housing becomes an integral part of the casing string. It will be readily appreciated by those skilled in the art that the housing 44 could instead be integrally formed with a section of the casing string 12.

A bow spring 46 ensures that the device 40 is biased against an inner wall of the wellbore 14, so that a large volume of cement 16 is not disposed between the device and the wellbore. This facilitates the later forming of a passage 48 for providing fluid communication between the chamber 36 and a zone or earth formation 50.

Figure 3:
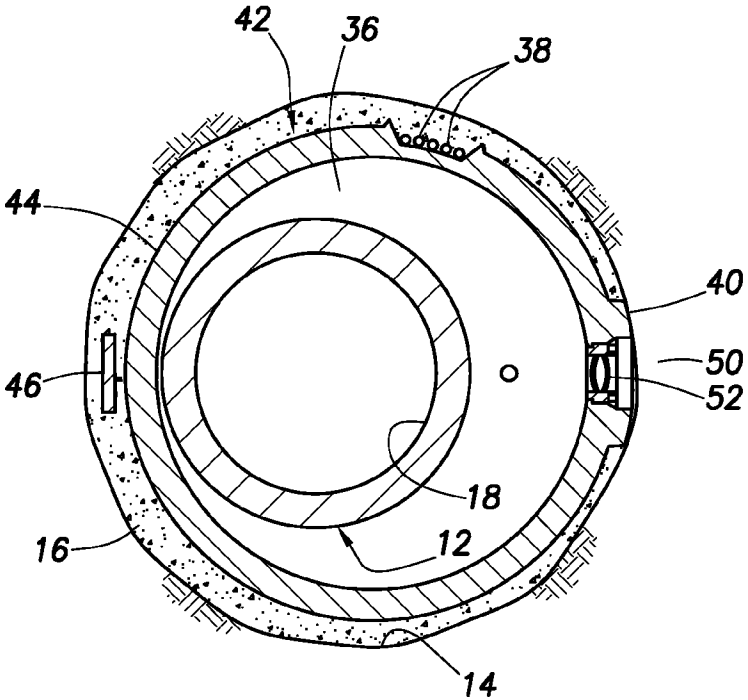
FIG. 3 is an enlarged scale cross-sectional schematic view of a first alternate construction of the pressure communication assembly.

Referring additionally now to FIG. 3, a cross-sectional view of a first alternate construction of the assembly 42 is representatively illustrated. In this view, the cement 16 has been placed about the housing 44 and casing string 12, but the passage 48 between the chamber 36 and the formation 50 has not yet been formed.

The device 40 in this construction of the assembly 42 includes a frangible member 52. The frangible member 52 could be, for example, a rupture disk of the type known to those skilled in the art, and which breaks or otherwise opens in response to a predetermined pressure differential applied across the rupture disk.

The pressure differential could be applied by applying pressure to the tube 38 connected to the chamber 36 from the surface. However, other methods of applying the pressure differential could be used in keeping with the principles of the invention. For example, a propellant could be ignited to create increased pressure in the chamber 36, pressure in the chamber and/or external to the chamber could be increased or decreased to apply the pressure differential, etc.

Figure 4:
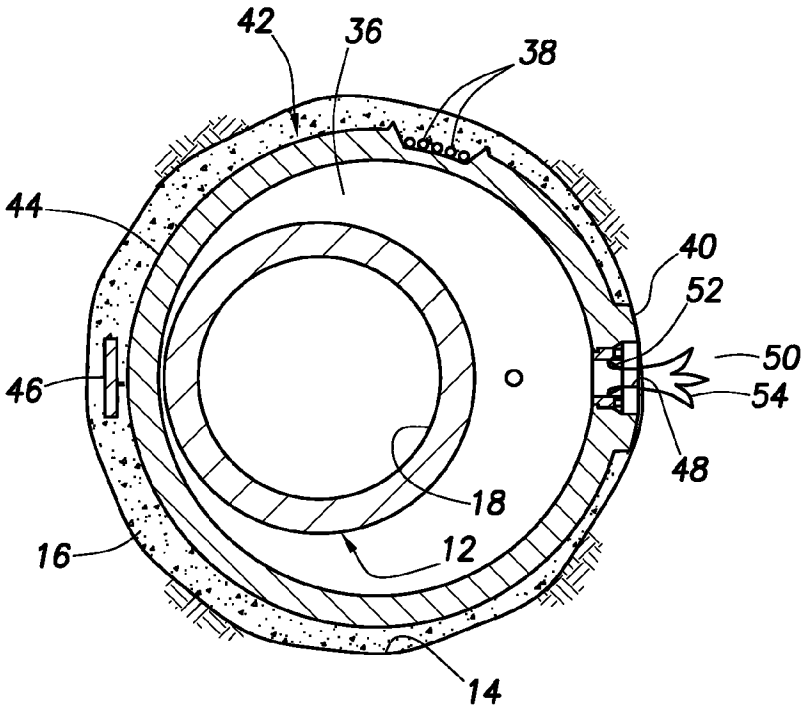
FIG. 4 is a cross-sectional schematic view of the first alternate construction, with a passage having been formed between a chamber of the assembly and an earth formation.

Referring additionally now to FIG. 4, the assembly 42 is depicted after the pressure differential has been applied and the member 52 has broken. As a result, the passage 48 has now been formed between the chamber 36 and the formation 50.

In addition, sufficient pressure has been applied to the formation 50 to cause small fractures 54 to be formed in the formation rock. These fractures 54 can increase the mobility of fluid in the formation 50 toward the wellbore 14, for example, by overcoming the skin damage caused during drilling and other previous operations. Furthermore, those skilled in the formation fracturing and testing arts will appreciate that a variety of characteristics of the formation 50 may be determined using the capabilities of the assembly 42 to directly monitor pressure in the formation, whether or not the fractures 54 are formed.

For example, the pressure communication assembly 42 may be used to repeatedly test the formation 50 over time by injecting and/or withdrawing fluid into or out of the formation. A transient pressure response of the formation 50 to this fluid transfer may be monitored by the pressure gauge at the remote location. This will enable a determination of properties of the formation 50 (such as relative permeability) over time.

Repeated micro-transient testing allows the determination of zonal relative permeabilities. This process is made possible by the pressure connectivity to the surface which is provided by the system 10 with the isolated pressure communication assemblies 20, 22, 24, 26 in observation positions relative to the zones or formations 28, 30, 32, 34. Repeated mini or micro drawdown and build-up pressure testing or injection and fall-off testing can be performed using this system 10 with the assemblies 20, 22, 24, 26 isolated behind the casing string 12 for monitoring pressure of single zones that are not producing in this well. Pressure transient analysis of this data can determine changes in reservoir permeability due to fluid saturation changes within the zones over time.

Note that it is not necessary in keeping with the principles of the invention for the fractures 54 to be formed. The passage 48 could be formed without also forming the fractures 54.

Figure 5:
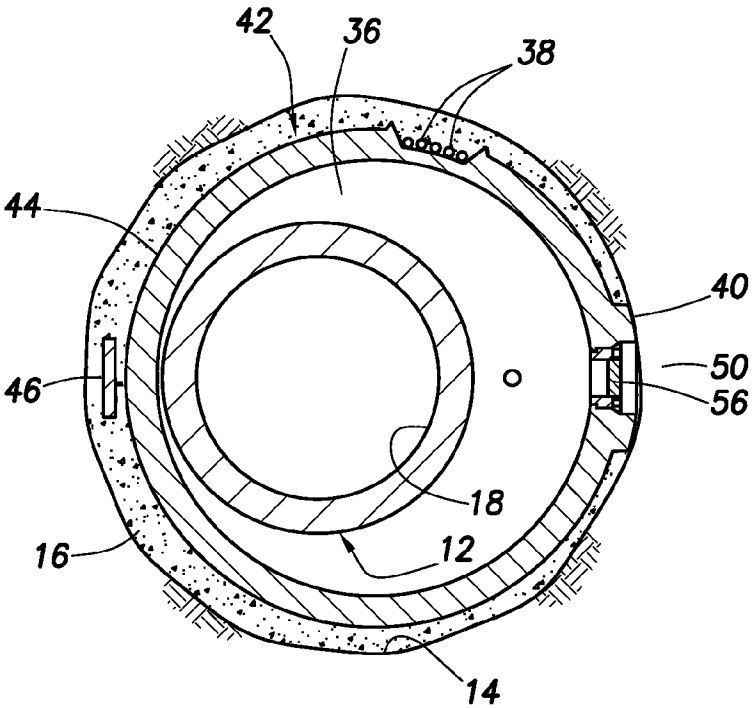
FIG. 5 is a cross-sectional schematic view of a second alternate construction of the pressure communication assembly.

Referring additionally now to FIG. 5, a schematic cross-sectional view of another alternate construction of the assembly 42 is representatively illustrated. In this embodiment, the device 40 includes a member 56 which is displaced in response to application of a predetermined pressure differential.

The member 56 could be, for example, a plug of the type known as a pump-out plug or disc. Instead of breaking like the frangible member 52 described above, the member 56 displaces when the pressure differential is applied.

Figure 6:
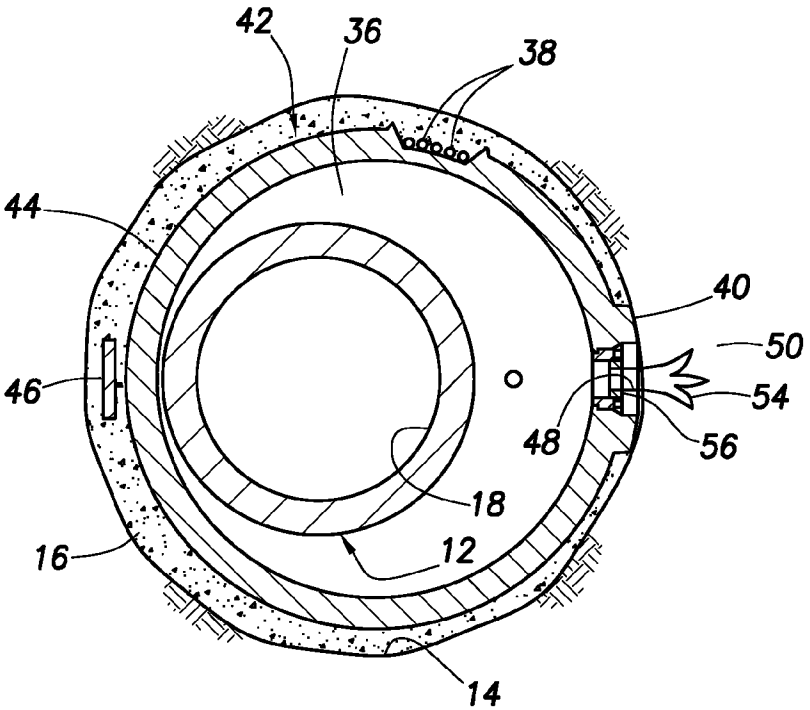
FIG. 6 is a cross-sectional schematic view of the second alternate construction, with a passage having been formed between a chamber of the assembly and an earth formation.

Referring additionally now to FIG. 6, the assembly 42 is depicted after the member 56 has displaced and the passage 48 between the chamber 36 and the formation 50 has been formed. The fractures 54 may be formed if desired, as described above.

Figure 7:
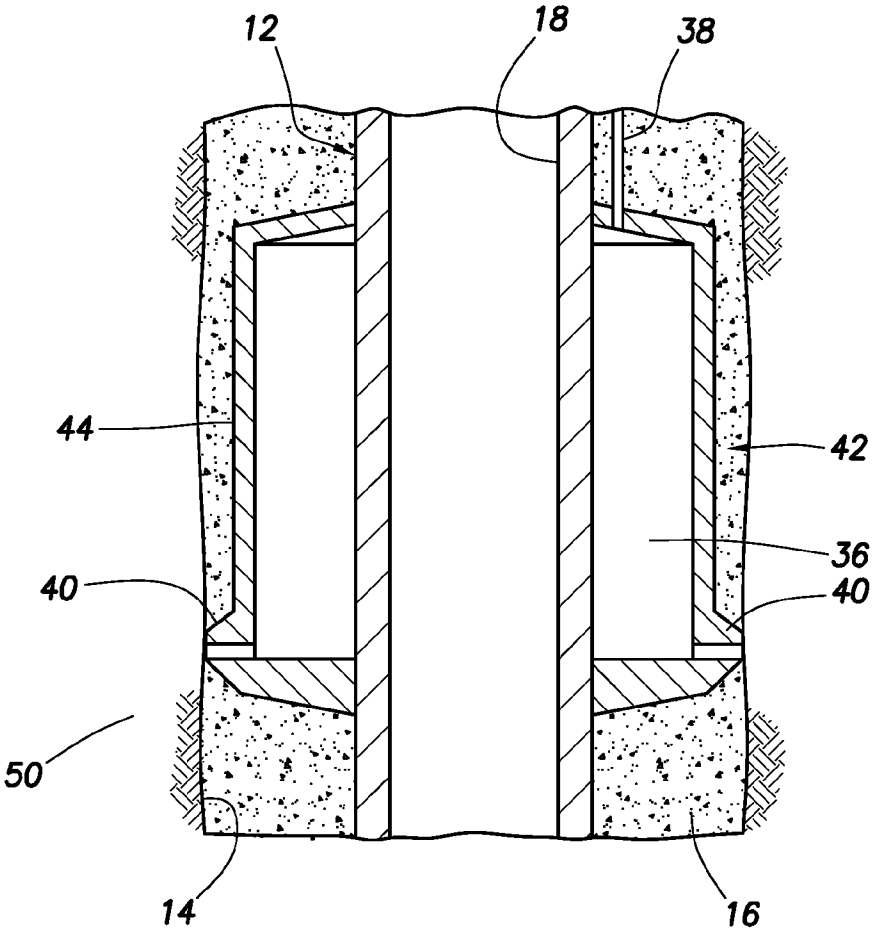
FIG. 7 is a cross-sectional schematic view of a third alternate construction of the pressure communication assembly.

Referring additionally now to FIG. 7, a schematic cross-sectional view of another alternate construction of the assembly 42 is representatively illustrated. This alternate construction is similar in most respects to the FIG. 2 embodiment. However, as depicted in FIG. 7 the assembly 42 includes multiple connectivity devices 40, the housing 44 is concentrically arranged about the casing string 12, and no bow spring 46 is used to bias the housing to one side of the wellbore 14.

Since the devices 40 are not biased against the walls of the wellbore 14 by the bow spring 46, the devices 40 in the FIG. 7 embodiment may include features which permit them to be extended outward upon installation of the assembly 42 in the well. In this manner, the presence of the cement 16 between the devices 40 and the formation 50 may be eliminated, or at least substantially reduced.

Figure 8:
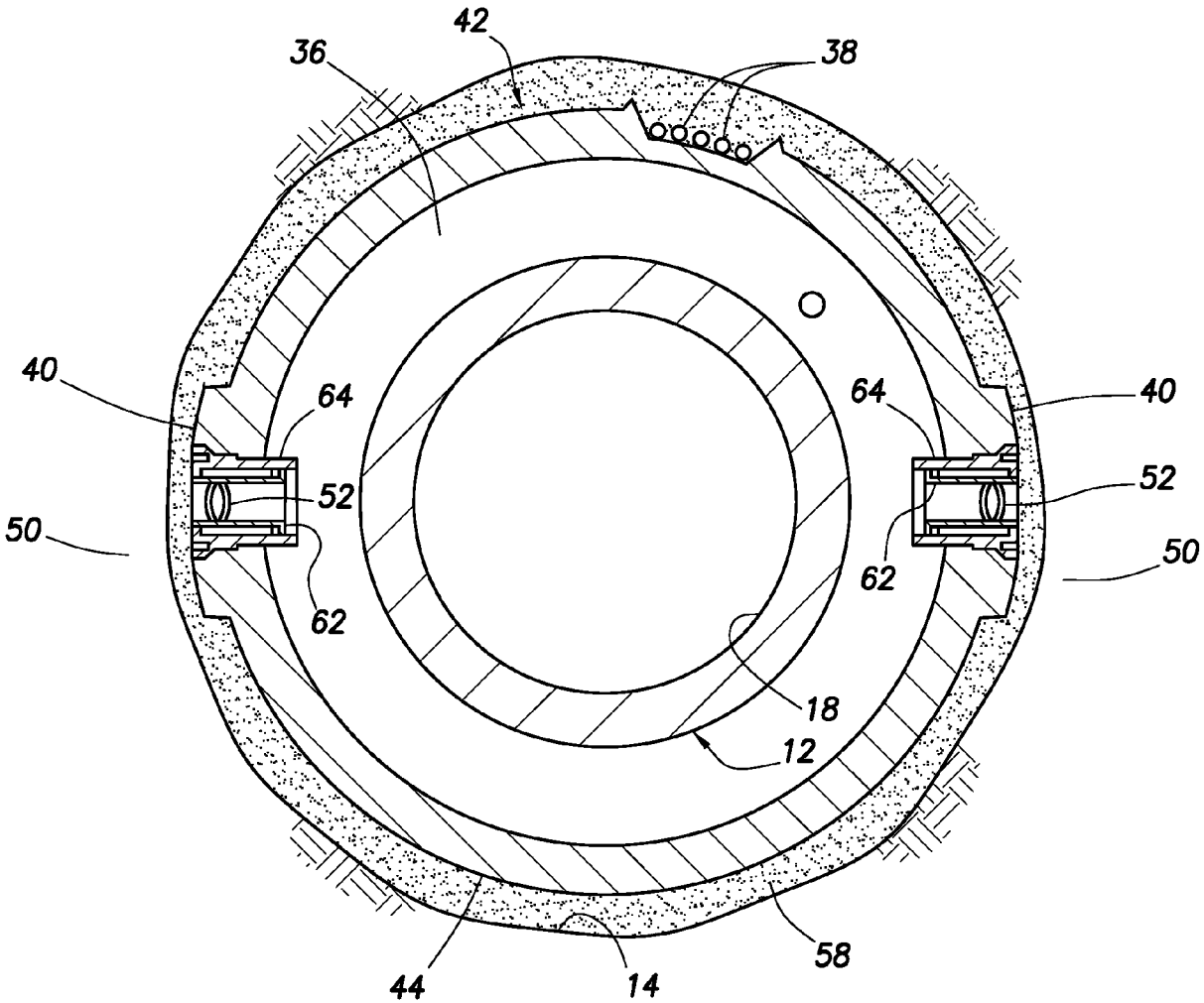
FIG. 8 is a cross-sectional schematic view of a fourth alternate construction of the pressure communication assembly.

Referring additionally now to FIG. 8, a schematic cross-sectional view of another alternate construction of the assembly 42 is representatively illustrated. Similar to the FIG. 7 embodiment, this construction of the assembly 42 includes two of the connectivity devices 40.

As depicted in FIG. 8, the assembly 42 and casing string 12 have been installed in the wellbore 14, but they have not yet been cemented therein. Instead, mud 58 fills the annular space between the housing 44 and the wellbore 14 at this point.

The devices 40 each include an extension member 62 in the form of a sleeve having a piston externally thereon. The piston is received in a seal bore in an outer sleeve 64. A frangible member 52, similar to that used in the FIG. 3 embodiment and described above, closes off the interior of the extension member 62.

When a predetermined pressure differential is applied to the devices 40, the extension members 62 will displace radially outward to approach or preferably contact the inner wall of the formation 50 on each side of the housing 44. In this manner, the presence of cement 16 between the frangible members 52 and the wellbore 14 may be reduced or eliminated. The extension members may be displaced radially outward prior to and/or during the cementing operation.

Figure 9:
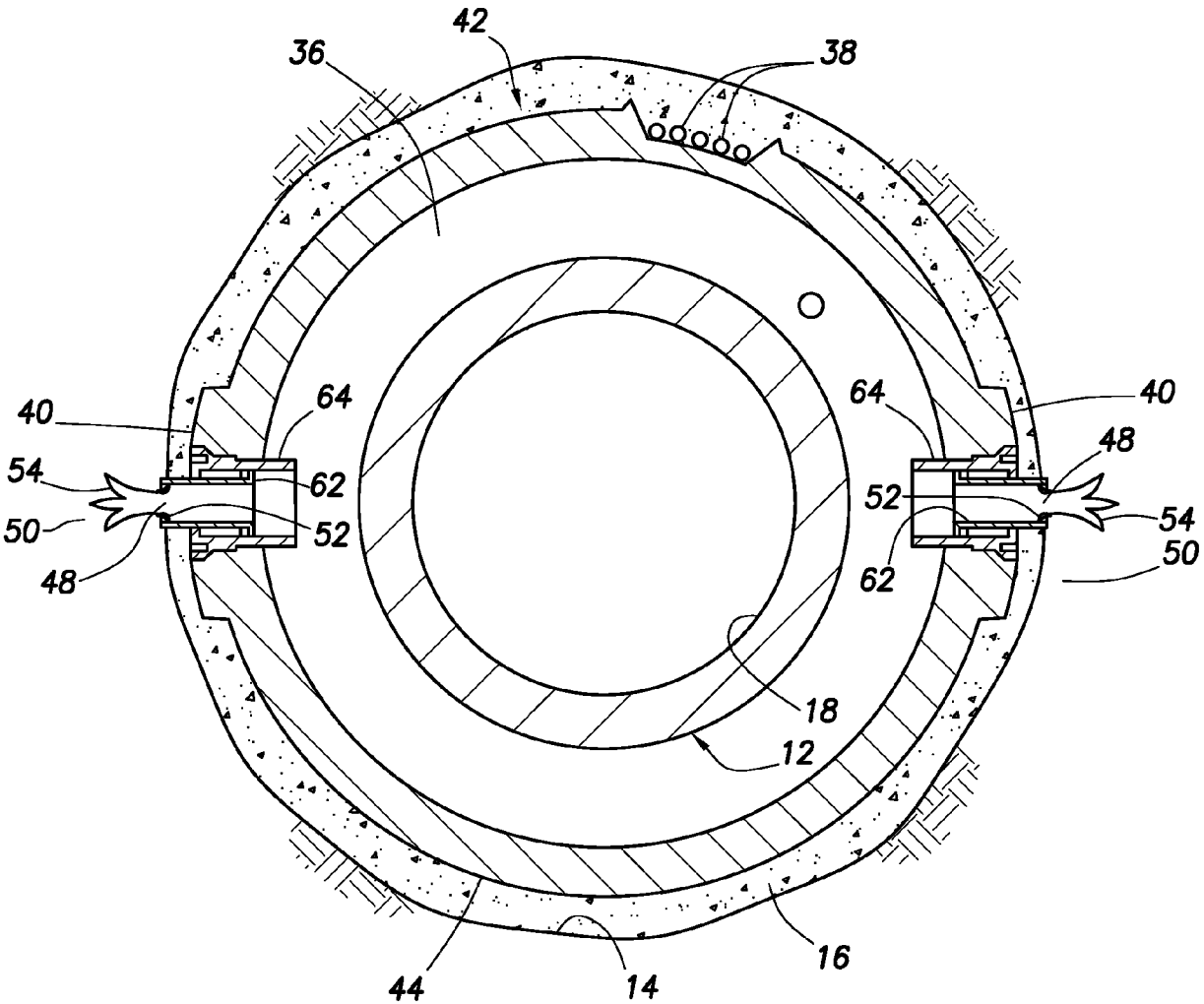
FIG. 9 is a cross-sectional schematic view of the fourth alternate construction, with a passage having been formed between a chamber of the assembly and an earth formation.

Referring additionally now to FIG. 9, the assembly 42 is representatively illustrated after the extension members 62 have been extended outward, the cement 16 has been placed about the housing 44, and the frangible members 52 have been broken. The frangible members 52 are broken in a manner similar to that described above for the FIG. 3 embodiment, by applying an increased pressure differential to the devices 40 after the extension members 62 are extended outward.

When the frangible members 52 are broken, the passages 48 are formed, thereby providing fluid communication between the chamber 36 and the formation 50. In addition, fractures 54 may be formed if desired, as described above.

Figure 10:
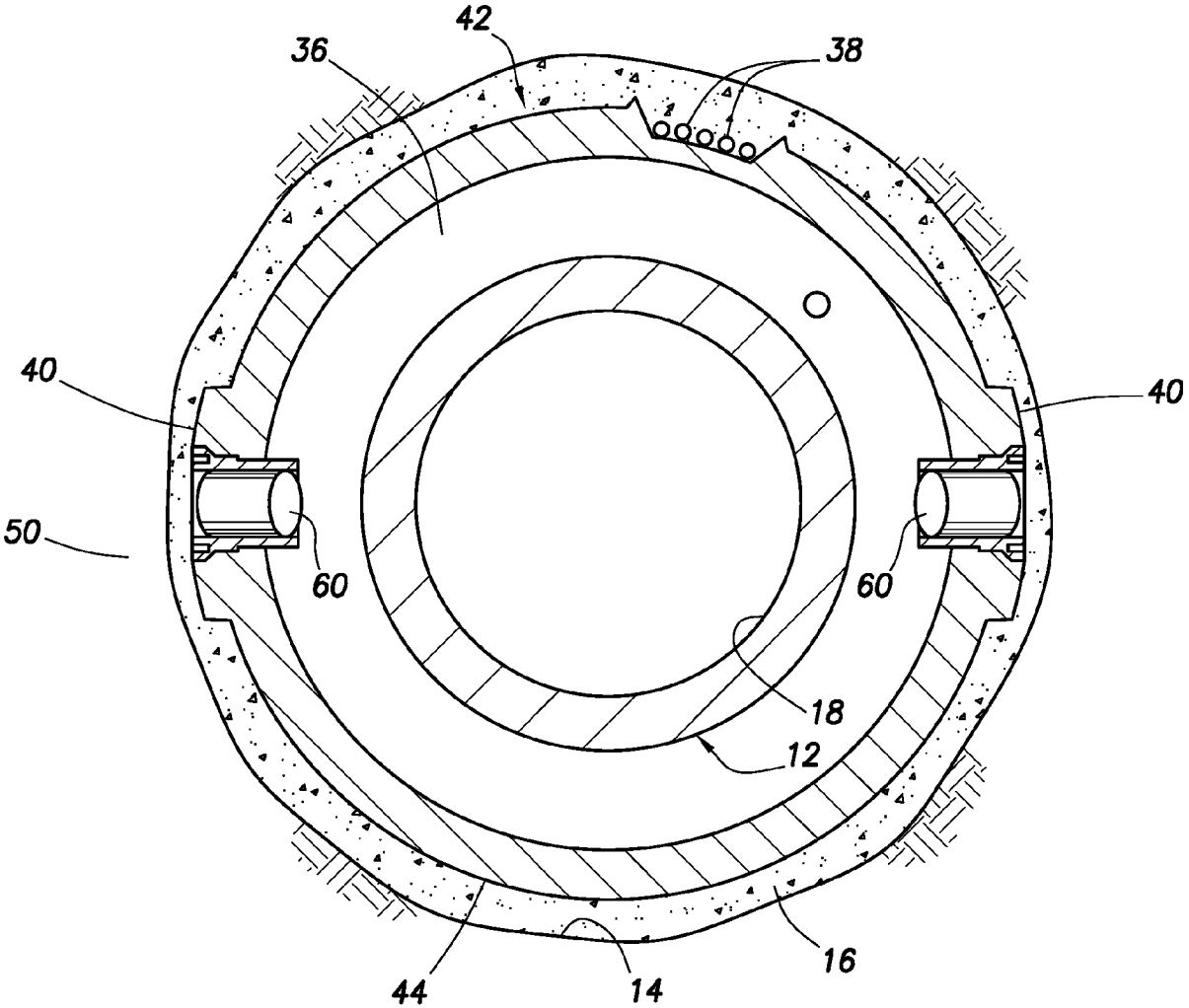
FIG. 10 is a cross-sectional schematic view of a fifth alternate construction of the pressure communication assembly.

Referring additionally now to FIG. 10, a schematic cross-sectional view of another alternate construction of the assembly 42 is representatively illustrated. This embodiment is similar to the embodiment of FIGS. 7-9, in that it includes multiple connectivity devices 40. However, the assembly 42 depicted in FIG. 10 includes explosive charges 60 in the connectivity devices 40.

The explosive charges 60 are preferably of the type used in well perforating guns and known as shaped charges. Other types of explosive charges may be used if desired, any number of explosive charges may be used, and the explosive charges may be detonated in any manner (for example, mechanically, electrically, hydraulically, via telemetry, using a time delay, etc.) in keeping with the principles of the invention.

As depicted in FIG. 10, the assembly 42 and casing string 12 have been cemented in the wellbore 14. The explosive charges 60 may now be detonated to thereby form the passages 48 and provide fluid communication between the formation 50 and the chamber 36.

Figure 11:
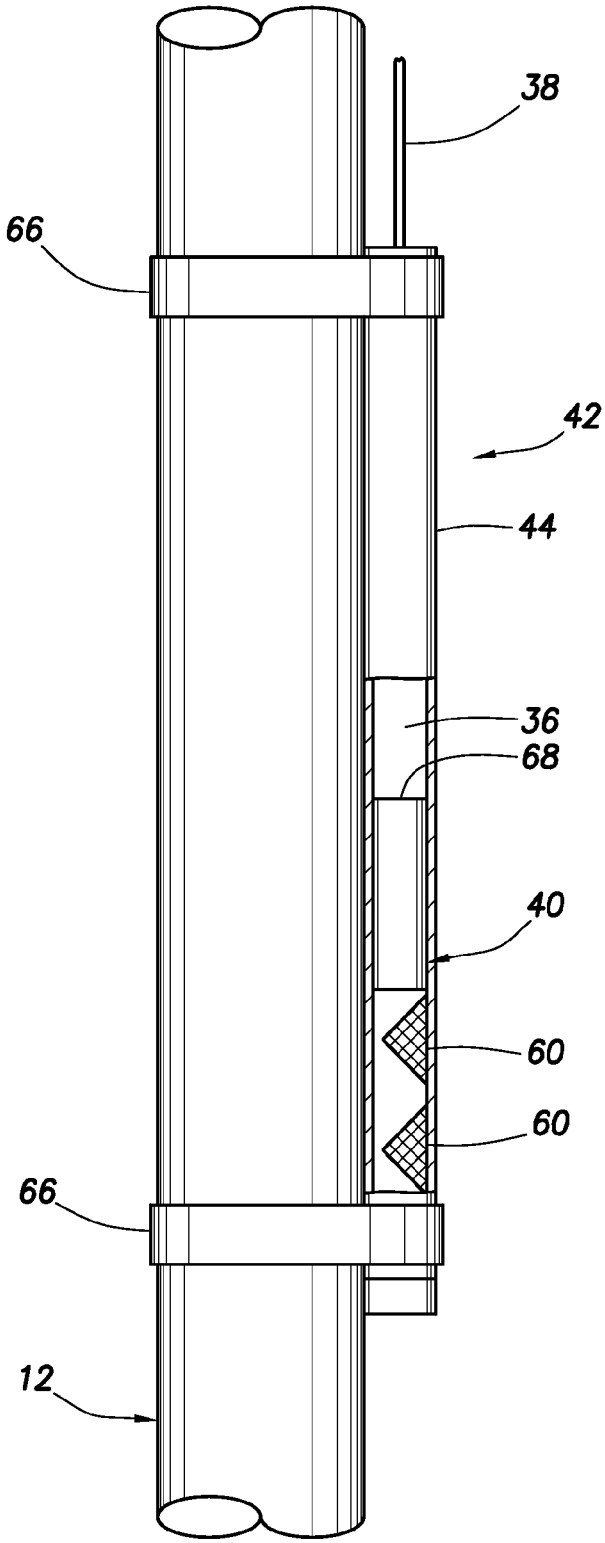
FIG. 11 is a cross-sectional schematic view of a sixth alternate construction of the pressure communication assembly.

Referring additionally now to FIG. 11, another alternate embodiment of the assembly 42 is representatively illustrated. In FIG. 11, the assembly 42 and casing string 12 are shown apart from the remainder of the well system 10 for clarity and convenience of illustration and description, but it should be understood that in actual practice the assembly and casing string would be installed in the wellbore 14 as described above and depicted in FIG. 1. Of course, the assembly 42 of FIG. 11 may be used in other well systems in keeping with the principles of the invention.

The assembly 42 of FIG. 11 is similar to the assembly of FIG. 10, in that it includes the explosive charges 60 for providing fluid communication between the chamber 36 and the formation 50. However, the assembly 42 as depicted in FIG. 11 is secured to the exterior of the casing string 12, for example, using clamps 66 and the explosive charges 60 are vertically aligned, rather than being radially opposite each other as in the FIG. 10 embodiment.

In addition, a pressure operated firing head 68 is included in the device 40 for controlling detonation of the explosive charges 60. The firing head 68 may be similar to conventional pressure operated firing heads used for well perforating guns. The firing head 68 may be used to detonate the charges 60 in the FIG. 10 embodiment, if desired. The explosive charges 60 are preferably detonated after the assembly 42 and casing string 12 have been cemented in the wellbore 14.

A predetermined pressure differential applied to the firing head 68 causes the firing head to detonate the explosive charges 60, thereby forming the passages 48 and providing fluid communication between the chamber 36 and the formation 50. The pressure differential may be between, for example, the chamber 36 and an internal chamber of the firing head 68. The pressure differential may be applied to the firing head 68 by applying pressure to the chamber 36 via the tube 38 from a remote location, such as the surface.

It may now be fully appreciated that the well system 10 and associated methods described above provide many benefits in well operations and monitoring of downhole pressure. Furthermore, a variety of new techniques have been described for providing fluid communication between the formation 50 and the chamber 36 of the assembly 42. It should be clearly understood that the invention is not limited to only these techniques, since other techniques could be used in keeping with the principles of the invention.

In addition, although the formation 50 and the formations 28, 30, 32 and 34 of FIG. 1 are described above as being pressure sources to which the chamber 36 may be connected downhole, other pressure sources could be connected to the chamber in keeping with the principles of the invention. For example, the chamber 36 could be placed in fluid communication with the interior of the casing string 12 by positioning the frangible member 52, plug member 56 or explosive charges so that the passage 48 is formed between the chamber and the bore 18 of the casing string. Thus, the interior of the casing string 12 could be a pressure source which is connected to the chamber 36 downhole.

Once the chamber 36 is placed in fluid communication with the pressure source downhole, pressure in the pressure source may be monitored by displacing a known fluid (such as helium, nitrogen or another gas or liquid) through the tube 38 and into the chamber. Pressure applied to the tube 38 at the surface or another remote location to balance the pressure applied to the chamber downhole by the pressure source provides an indication of the pressure in the pressure source. Various techniques for accurately determining this pressure (including use of optical fiber distributed temperature sensing systems, etc.) are well known to those skilled in the art, and some of these techniques are described in the U.S. patents and patent application discussed above.

Even though the pressure communication assembly 42 and its alternate embodiments have been illustrated and described as each including only one type of the device 40 (for example, including the frangible member 52, displaceable member 56 or explosive charge 60), it will be appreciated that any combination of the types of devices could be provided in a pressure communication assembly (for example, to provide redundancy). Furthermore, any number of the devices 40 may be provided in the pressure communication assembly 42 and its alternate embodiments.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well system for measuring formation pressure, comprising:

a casing string positioned in the well, with a bore extending longitudinally through the casing string;

a chamber attached to the casing string and positioned radially external to the casing string bore;

cement disposed in an annular space between the casing string and a wellbore; and a device which reduces a distance between an inlet to the chamber and a pressure source external to the casing string prior to the cement hardening in the annular space, and which initiates fluid communication between an interior of the chamber and the pressure source external to the casing after the cement has hardened in the annular space.

2. The well system of claim 1, wherein the pressure source is an earth formation external to the casing string.

3. The well system of claim 1, wherein a tube is connected to the chamber for pressure communication with the earth formation, the tube extending between the chamber and a remote location.

4. The well system of claim 1, wherein the device includes a frangible member which breaks upon application of a predetermined pressure differential across the frangible member in the well.

5. The well system of claim 1, wherein the device includes a member which displaces upon application of a predetermined pressure differential in the well.

6. The well system of claim 1, wherein the device includes an explosive charge which is detonated to form a passage between the chamber and the pressure source.

7. A well system for measuring formation pressure, comprising:

a casing string positioned in the well, with a bore extending longitudinally through the casing string;

a chamber attached to the casing string and positioned radially external to the casing string bore; and a device which initiates fluid communication between an interior of the chamber and a pressure source external to the casing, wherein the device includes an explosive charge which is detonated to form a passage between the chamber and the pressure source, and wherein the explosive charge is detonated in response to application of a predetermined pressure differential in the well.

8. The well system of claim 1, wherein the device forms a passage between the chamber and the pressure source.

9. The well system of claim 1, wherein the device forms at least one fracture in an earth formation external to the casing string.

10. A method of monitoring pressure in a well, the method comprising the steps of:

installing a casing string in the well with a chamber positioned radially external to a through bore of the casing string, and the chamber being isolated from the well external to the casing string;

reducing a distance between a connectivity device of the chamber and a formation external to the casing string; and then actuating the device to thereby initiate fluid communication between the chamber and the formation.

11. The method of claim 10, further comprising the step of cementing the casing string in the well prior to the actuating step.

12. The method of claim 10, wherein the actuating step further comprises applying a predetermined pressure differential to the device.

13. The method of claim 12, wherein the actuating step further comprises breaking a frangible member of the device in response to the step of applying the pressure differential to the device.

14. The method of claim 12, wherein the actuating step further comprises displacing a member of the device in response to the step of applying the pressure differential to the device.

15. A method of monitoring pressure in a well, the method comprising the steps of:

installing a casing string in the well with a chamber positioned radially external to a through bore of the casing string, and the chamber being isolated from the well external to the casing string; and then actuating a device to thereby initiate fluid communication between the chamber and a formation external to the casing string, wherein the actuating step further comprises applying a predetermined pressure differential to the device, and wherein the actuating step further comprises detonating an explosive charge of the device in response to the step of applying the pressure differential to the device.

16. The method of claim 12, wherein the applying step further comprises applying the pressure differential via a tube connected to the chamber and extending to a remote location.

17. The method of claim 10, further comprising the step of forming a passage between the chamber and the formation external to the casing string.

18. The method of claim 10, further comprising the step of utilizing the device to form at least one fracture in the formation external to the casing string.

19. The method of claim 10, wherein the actuating step further comprises forming a passage through cement external to the chamber.

20. The method of claim 10, further comprising the step of testing the formation external to the casing string by transferring fluid between the formation and the chamber.

* * * * *